US011445749B2

(12) United States Patent
Miller

(10) Patent No.: US 11,445,749 B2
(45) Date of Patent: Sep. 20, 2022

(54) SMOKING PIPE ASSEMBLY

(71) Applicant: Matt Miller, Long Beach, CA (US)

(72) Inventor: Matt Miller, Long Beach, CA (US)

( * ) Notice: Subject to any disclaimer, the term of this patent is extended or adjusted under 35 U.S.C. 154(b) by 250 days.

(21) Appl. No.: 16/865,399

(22) Filed: May 3, 2020

(65) Prior Publication Data

US 2020/0260778 A1 Aug. 20, 2020

Related U.S. Application Data

(60) Provisional application No. 62/872,159, filed on Jul. 9, 2019.

(51) Int. Cl.

| | |
|---|---|
| ***A24F 1/32*** | (2006.01) |
| ***A24F 3/00*** | (2006.01) |
| ***A24F 9/10*** | (2006.01) |
| ***A24F 5/08*** | (2006.01) |
| ***A24F 5/10*** | (2006.01) |
| ***A24F 9/16*** | (2006.01) |

(52) U.S. Cl.

CPC ..... *A24F 1/32* (2013.01); *A24F 3/00* (2013.01); *A24F 5/08* (2013.01); *A24F 5/10* (2013.01); *A24F 9/10* (2013.01); *A24F 9/16* (2013.01)

(58) Field of Classification Search

CPC ..... A24F 1/32; A24F 3/00
USPC ..... 131/180
See application file for complete search history.

(56) References Cited

U.S. PATENT DOCUMENTS 1,292,648 A * 1/1919 Reynolds ..... A24F 5/08 131/183
2,087,741 A * 7/1937 Slepian ..... A24F 5/06 131/331
4,201,231 A * 5/1980 Palmer ..... A24F 5/10 131/176
4,252,135 A 2/1981 Herman
D259,587 S 6/1981 Jergenson
(Continued)

FOREIGN PATENT DOCUMENTS

CH 92205 A * 12/1921
GB 1479999 A * 7/1977 ..... A24F 5/08

OTHER PUBLICATIONS

Machine Translation of CH 92205 (Year: 1921).*
(Continued)

*Primary Examiner* — Kelly M Gambetta
*Assistant Examiner* — Russell E Sparks
(74) *Attorney, Agent, or Firm* — Scot Fagerland

(57) ABSTRACT

A brass smoking pipe is modified with numerous improvements. It is nickel-brass plated to prevent tarnishing. The draft holes are enlarged from the standard 1/16" to 3/32" diameter and drilled at an angle. The tar trap is drilled into a new deep-dish configuration. These modifications improve the pipe's draw. A titanium or quartz crystal retaining rod is provided, both to store multiple quartz crystal bowls in the storage canister and to serve as a domeless nail, converting an herb pipe to a concentrate pipe. A push nut holds quartz crystal bowls on the retaining rod. An oversized poker, available in brass, titanium, or glass, holds the tar trap in place and removes the tar trap for cleaning. The poker may be fitted with an easy-pull grip nut or a removal tool to remove the retaining rod and quartz crystal bowls from the storage canister.

6 Claims, 12 Drawing Sheets

(56) References Cited

U.S. PATENT DOCUMENTS 4,743,302 A * 5/1988 Dumesnil ..... C03C 8/245
501/15
D754,918 S 4/2016 Jergenson

OTHER PUBLICATIONS

Mendo Pipe & Us, http://www.mendopipe.com/about.html (Year: 2020).*
www.MendoPipe.com (captured and archived Feb. 12, 2020). See esp. lower right figure with long poker protruding into smoking cylinder.
https://www.proto-pipe.com/product/proto-pipe-classic/ (captured and archived Feb. 12, 2020).
https://www.proto-pipe.com/product/proto-rocket/ (captured and archived Feb. 12, 2020).
https://www.proto-pipe.com/product/proto-poker/ (captured and archived Feb. 12, 2020).
https://www.proto-pipe.com/product/proto-pipe-classic-tar-trap/ (captured and archived Feb. 12, 2020).
https://takeasmoke.com/product/high-efficiency-smoking-pipe/ (captured and archived Feb. 12, 2020).

* cited by examiner

SMOKING PIPE ASSEMBLY

1. FIELD OF THE INVENTION

This invention is in the field of smoking pipes, specifically brass pipes.

2. BACKGROUND OF THE INVENTION

The classic smoking pipe is made of hard wood. It is used to smoke dry herbs such as tobacco. The pipe has a bowl to contain the leaves, which are then lit to produce smoke. The smoke is then inhaled through a hollow stem. Modern pipes are made of glass or metal. In addition to dry leaves, modern pipes are also used to smoke vapors from hot oils.

3. DESCRIPTION OF RELATED TECHNOLOGY

In the $20^{th}$ century, Phil Jergenson invented the popular brass smoking pipe, the subject of U.S. Pat. D259,587. Jergenson's pipe has a brass bowl for containing dry herbs. The bottom of the bowl is perforated with draft holes. Directly beneath the draft holes is a hollow chamber. The smoke channel leads out of this hollow chamber into the stem. At the bottom of the hollow chamber is a tar trap, which collects gummy residue that drips through the draft holes when the herbs are burned.

One well known problem with Jergenson's pipe is that it is notoriously difficult to remove the tar trap for cleaning. The tar glues the trap into place. Another problem is that the pipe tarnishes over time. Further, the pipe is a product of earlier times when herbs were harder to clean. The draft holes are limited to 1/16" in diameter in order to keep dirt from falling into the hollow chamber. The small draft holes limit the pipe's airflow capacity, known in the art as the draw.

4. SUMMARY OF THE INVENTION

The present invention is a modification of Jergenson's pipe with several improvements. It is nickel-and-brass plated to prevent tarnishing. It has enlarged draft holes and an enlarged tar trap for increased draw. The invention provides a groove and O-ring around the tar trap for greater ease of removal and cleaning.

A quartz crystal bowl is provided. The quartz crystal bowl is useful for smoking dry herb, oil, or oil-infused herb. The invention provides a plurality of quartz crystal bowls, which fit inside the storage chamber as a cartridge. Other improvements will be presented in detail below.

5. BRIEF DESCRIPTION OF THE DRAWINGS

FIG. 6, subfigures 6A-6E, depicts variations of the poker grip nut.

Figure 7:
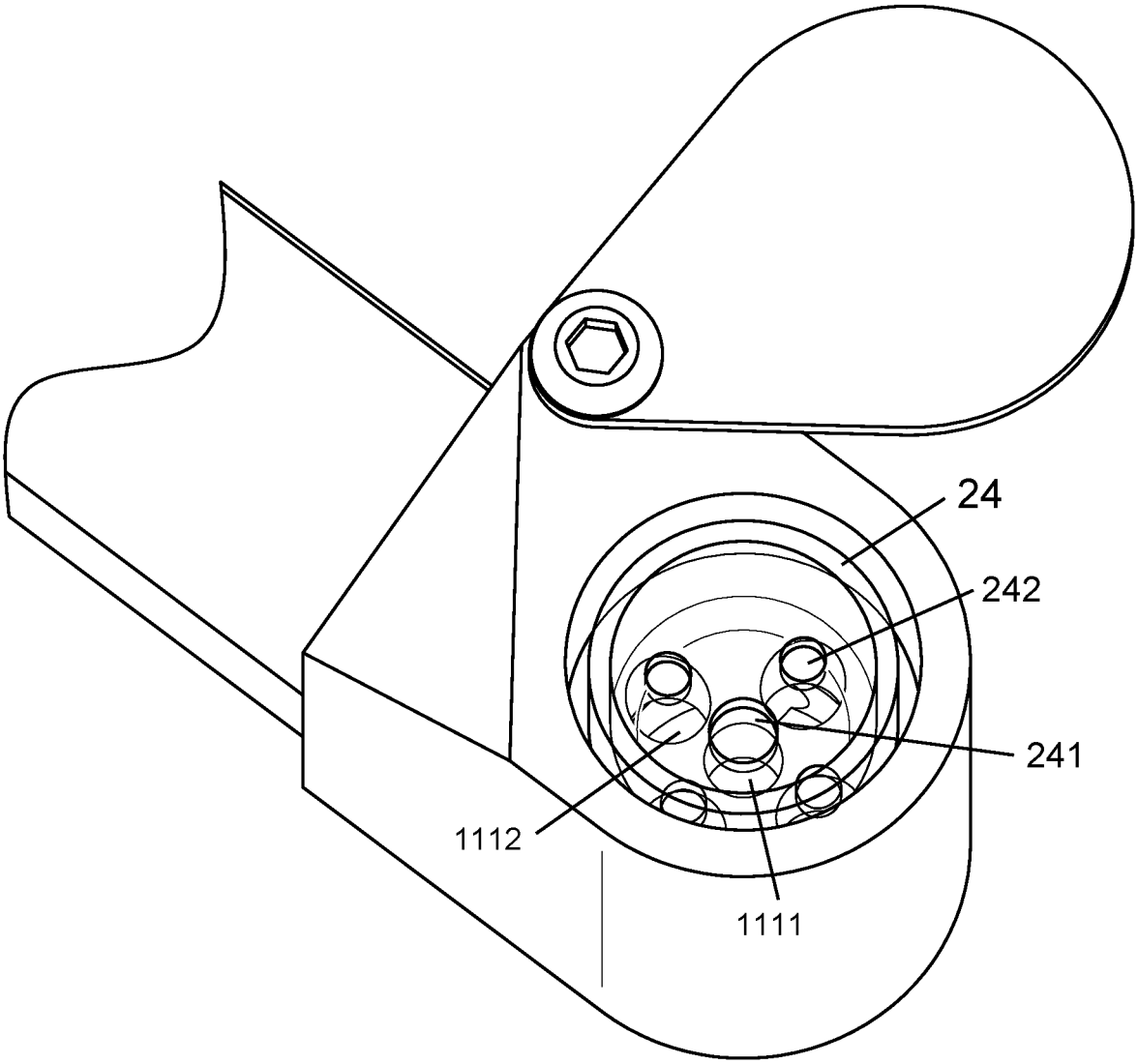

FIG. 7 shows a small removable glass smoking bowl inside the invention's fixed brass bowl.

Figure 8:
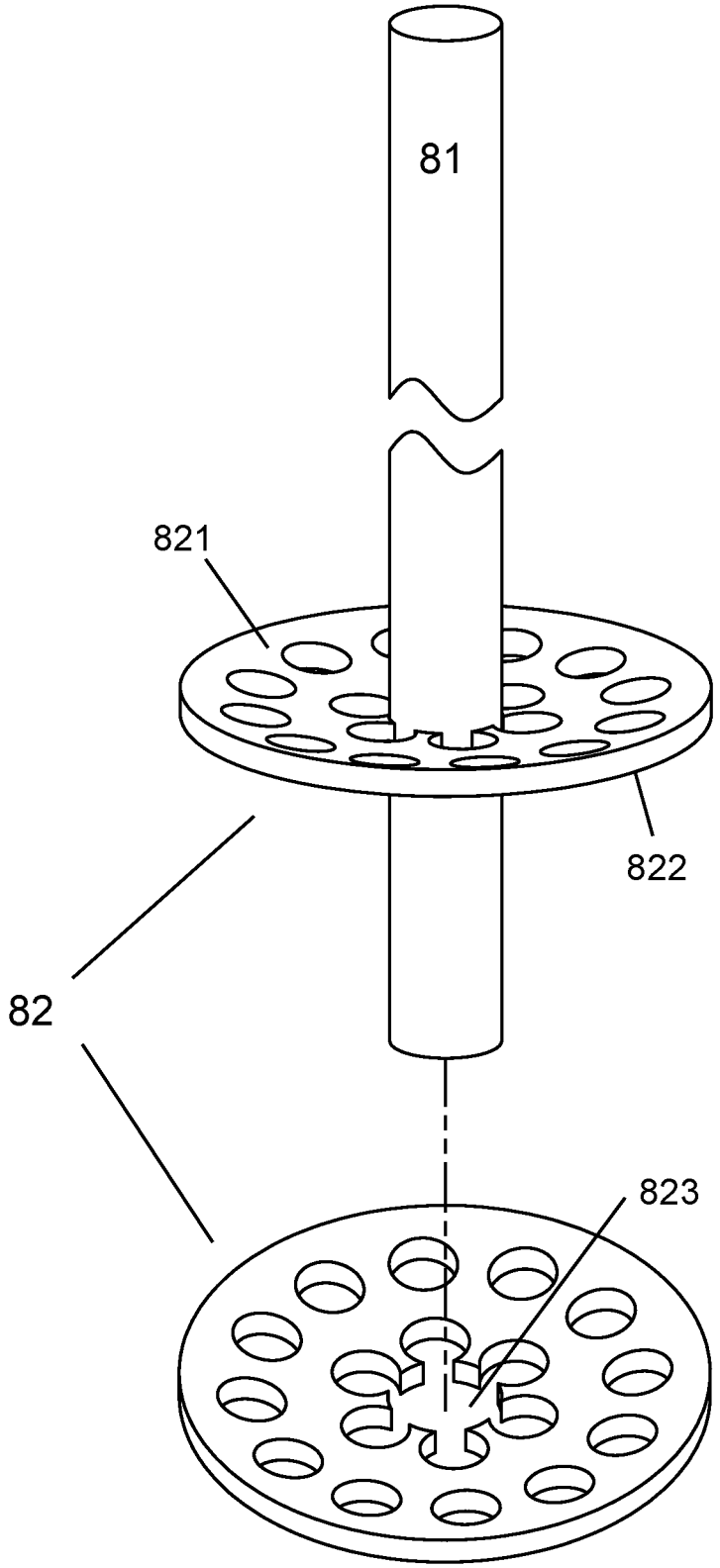

FIG. 8 shows a perforated washer modified to form a push nut. It also shows such a washer inserted onto a retaining rod.

Figure 9:
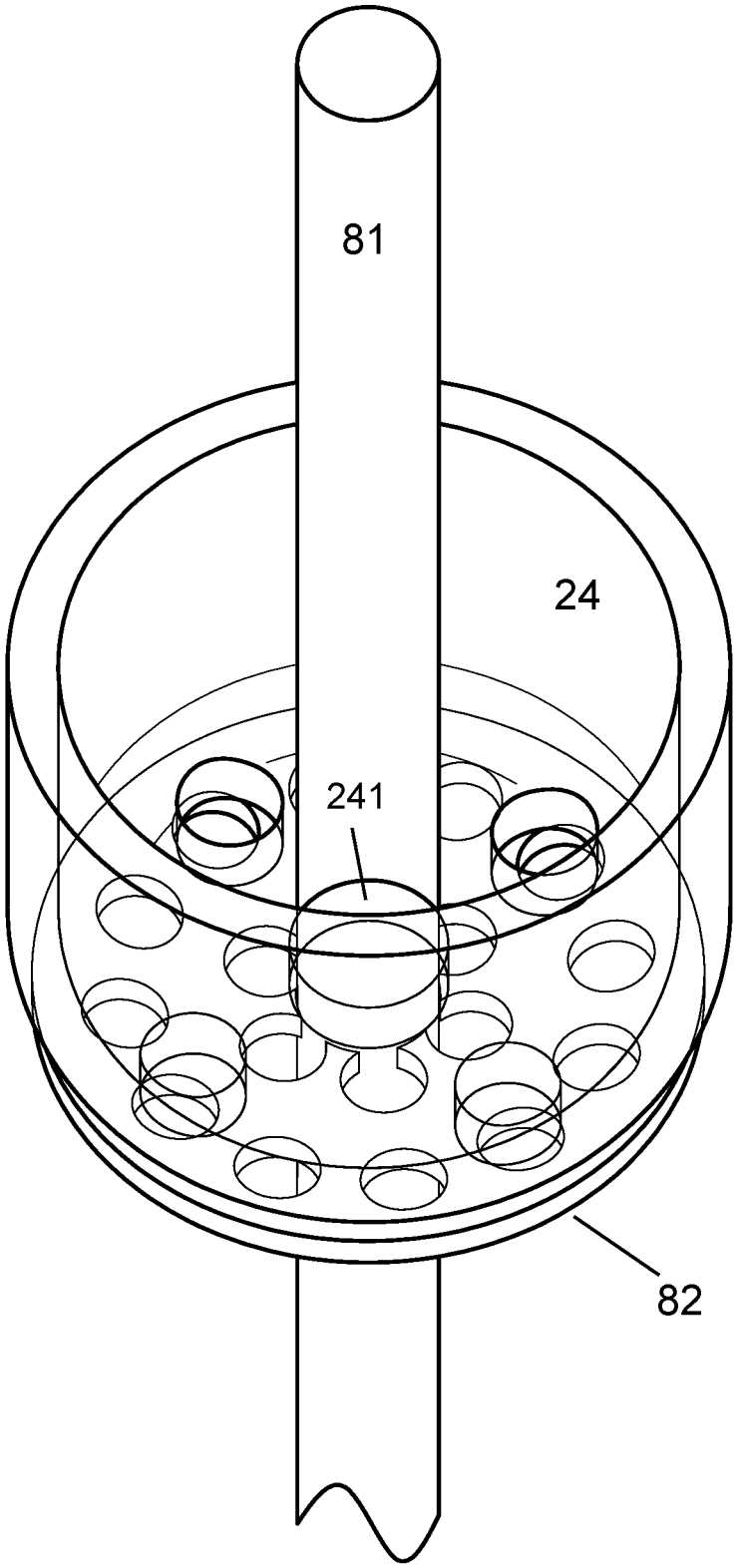

FIG. 9 shows a retaining rod inserted into a quartz crystal bowl. The quartz crystal bowl is supported by a push nut.

Figure 10:
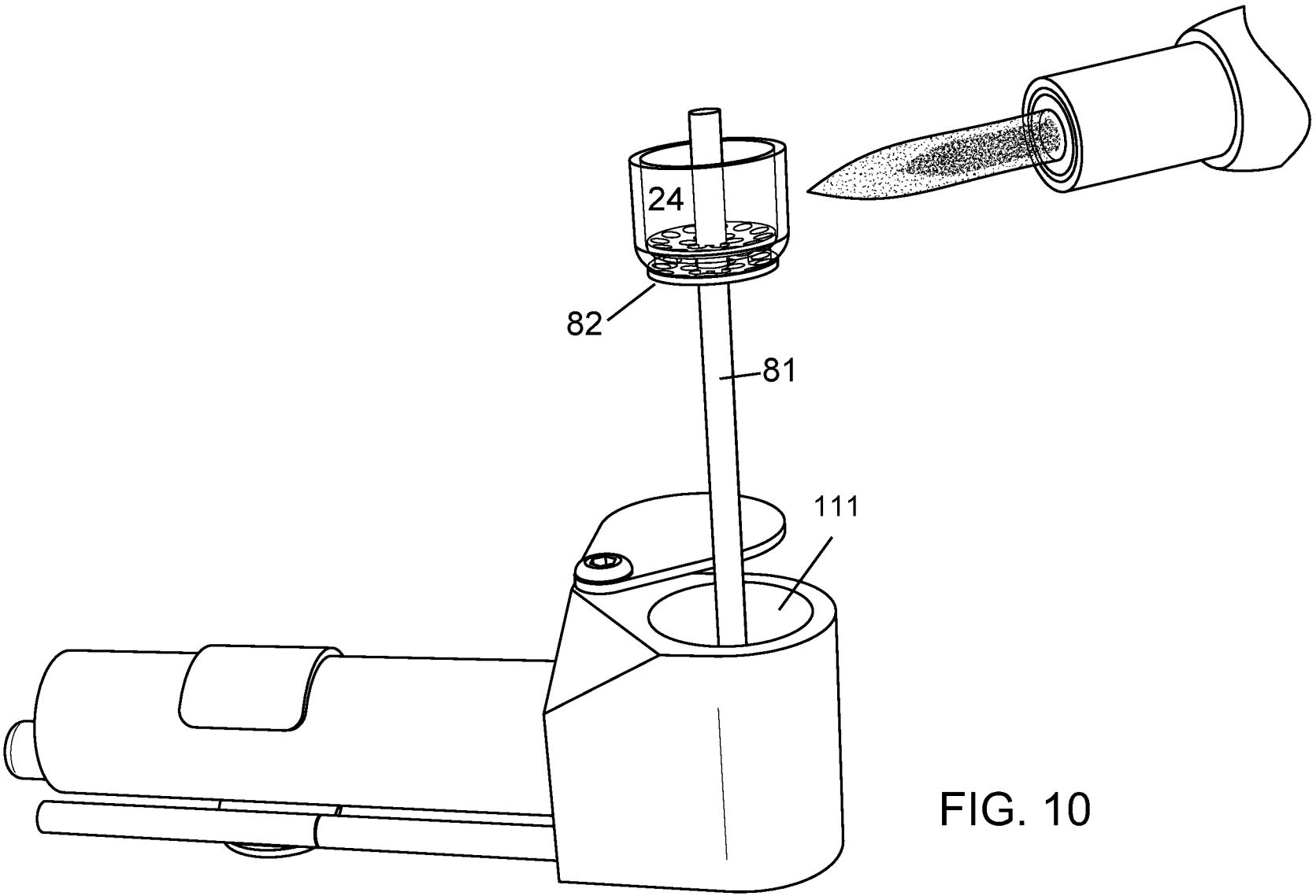

FIG. 10 shows the configuration of FIG. 9 inserted into the brass pipe, as a flame heats the quartz crystal bowl.

Figure 11:
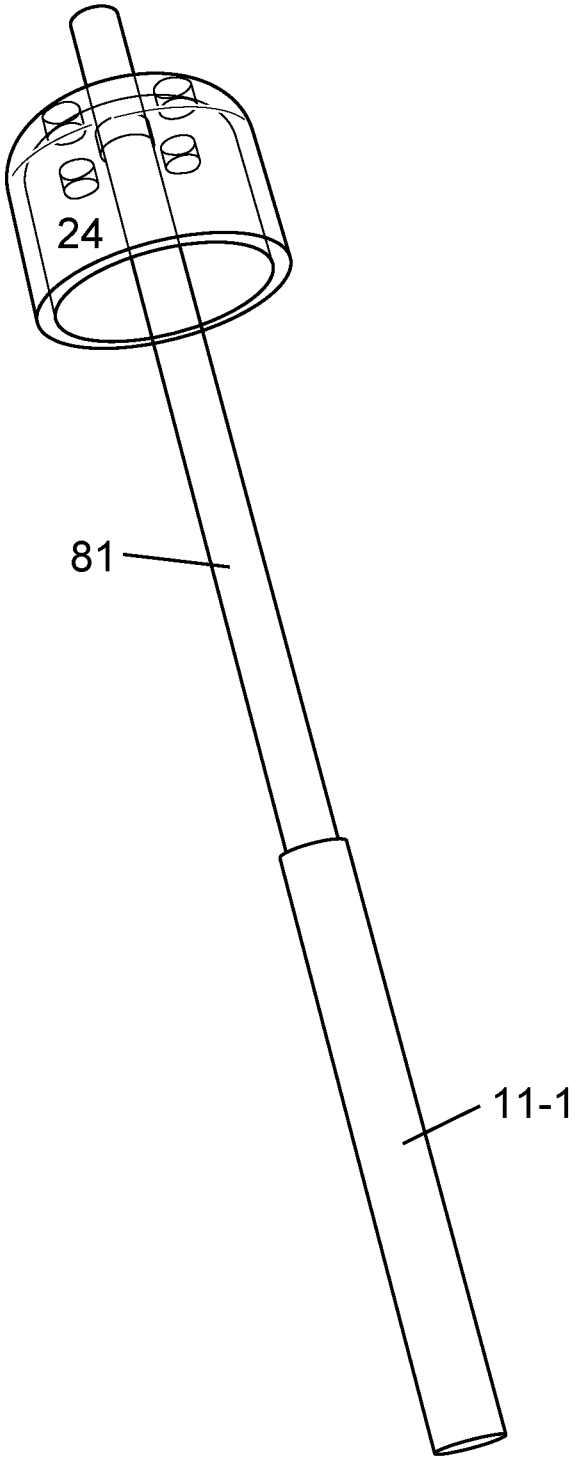

FIG. 11 shows a quartz crystal bowl inserted onto one end of a retaining rod.

Figure 12:
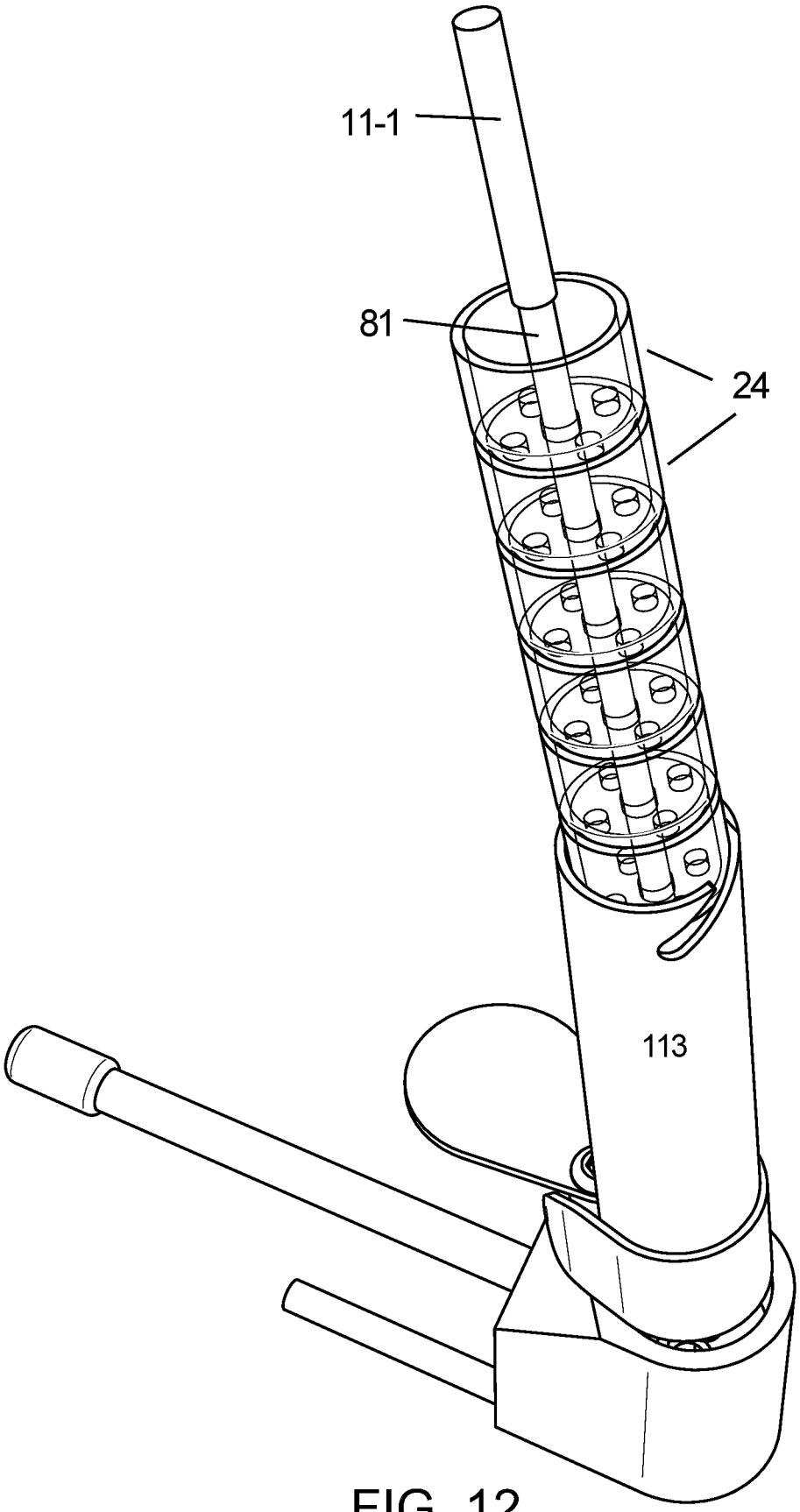

FIG. 12 shows a plurality of quartz crystal bowls inserted onto a retaining rod. They are being lowered into a storage canister, like cartridges in a magazine.

Figure 13:
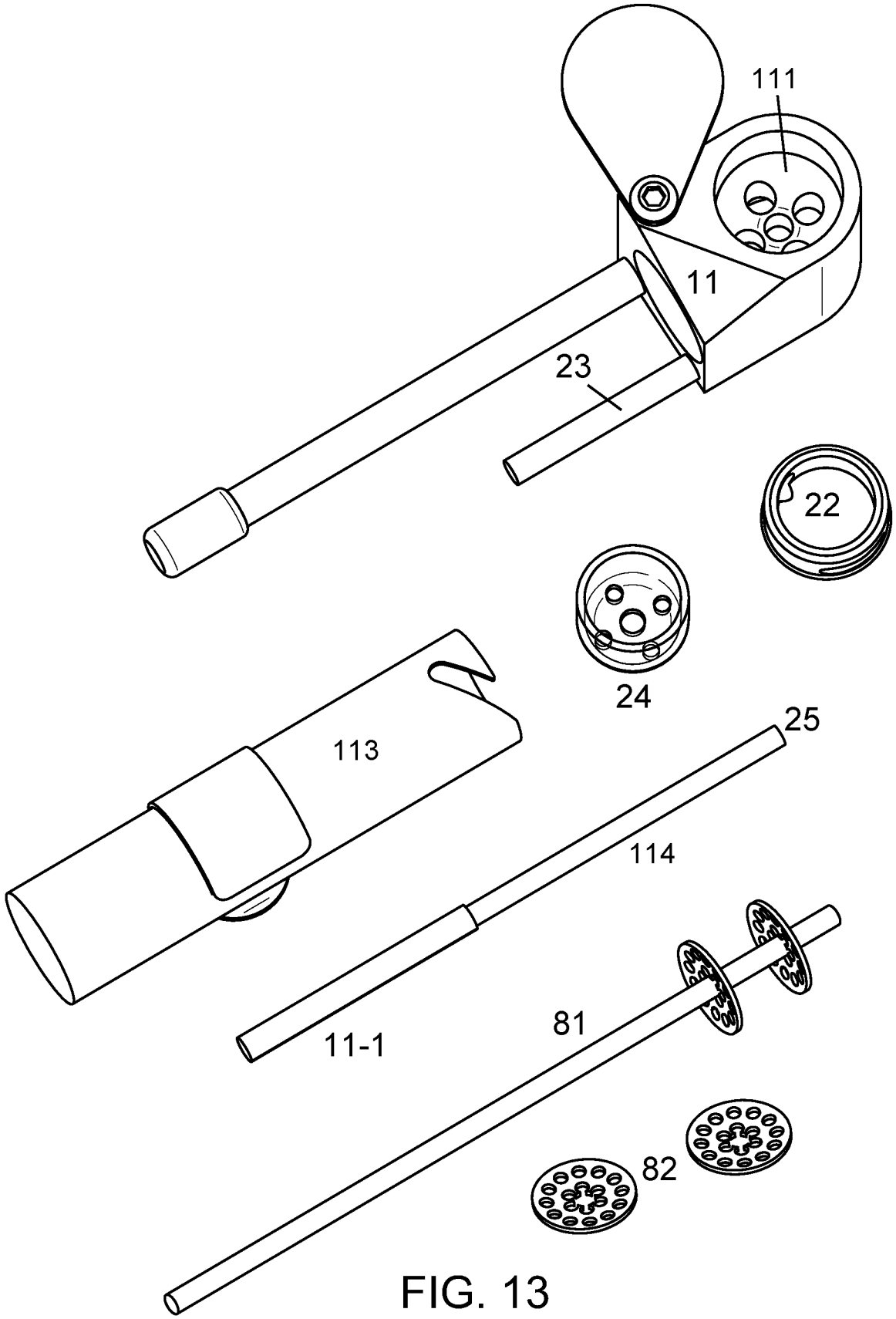

FIG. 13 shows all the components of the smoking pipe assembly.

6. DETAILED DESCRIPTION OF THE PREFERRED EMBODIMENTS

Figure 2:
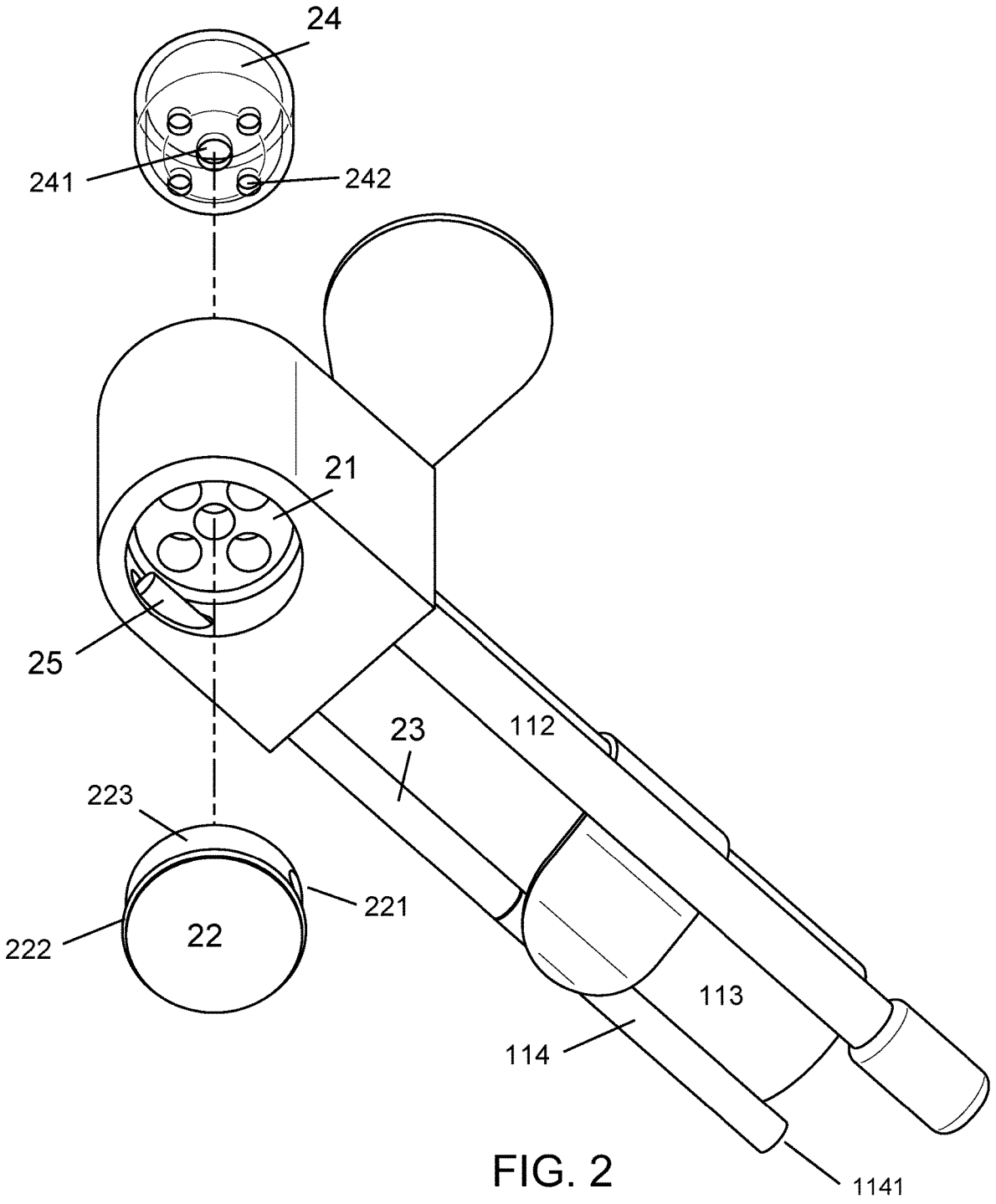
FIG. 2 is a first perspective view of the bottom of the invention. This figure shows a tar trap positioned to be inserted into a chamber on the bottom of the invention, and a quartz crystal bowl positioned to be inserted into the quartz crystal bowl on the top of the invention.

Each part of the invention is numbered with a digit that indicates the figure in which the part first appears. For example, part 221 first appears in FIG. 2. If that part has sub-parts in the same figure, then the sub-part number begins with the part number. For instance, part 221 is the first sub-part of part 22.

The invention is a modified brass smoking pipe. Production begins with a standard solid brass pipe 11, ideally Jergenson's pipe or a similar article. The essential parts of the unmodified pipe are a brass bowl 111 with a central draft hole 1111 and peripheral draft holes 1112, a mouthpiece 112, a storage canister 113, a removable poker 114 that fits into a poker stem 23, a hollow chamber 21 beneath the brass bowl, and a removable tar trap 22 that fits within the hollow chamber.

The improved pipe is coated with a plate of nickel, which is then plated with another layer of brass. This plating is enough to keep the pipe from tarnishing.

Figure 1:
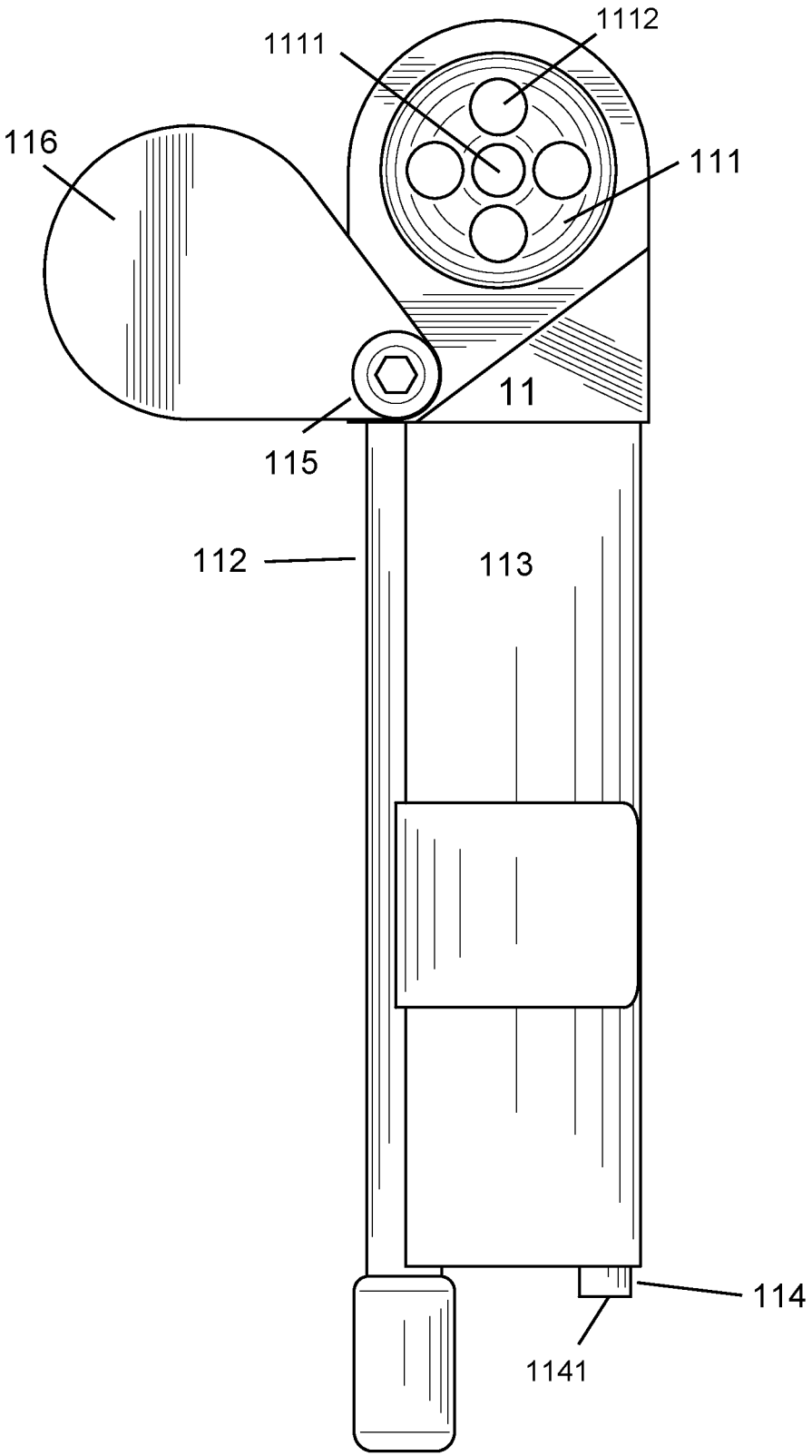
FIG. 1 shows a top view looking into the brass bowl.

The draft holes in a standard brass pipe are 1/16 inch in diameter. This is a holdover from days when available herbs were dryer and dirtier than today (about 5% dirt by volume). With today's cleaner product, the pipe can function with larger holes. The next modification is to use a drill to expand each draft hole 1111 and 1112 to a diameter of 3/32 inch. See FIG. 1. Furthermore, each peripheral draft hole 1112 is drilled at an angle deviating 10-30° (optimally) 15° from vertical. This helps to reduce tar trap buildup.

Figure 4:
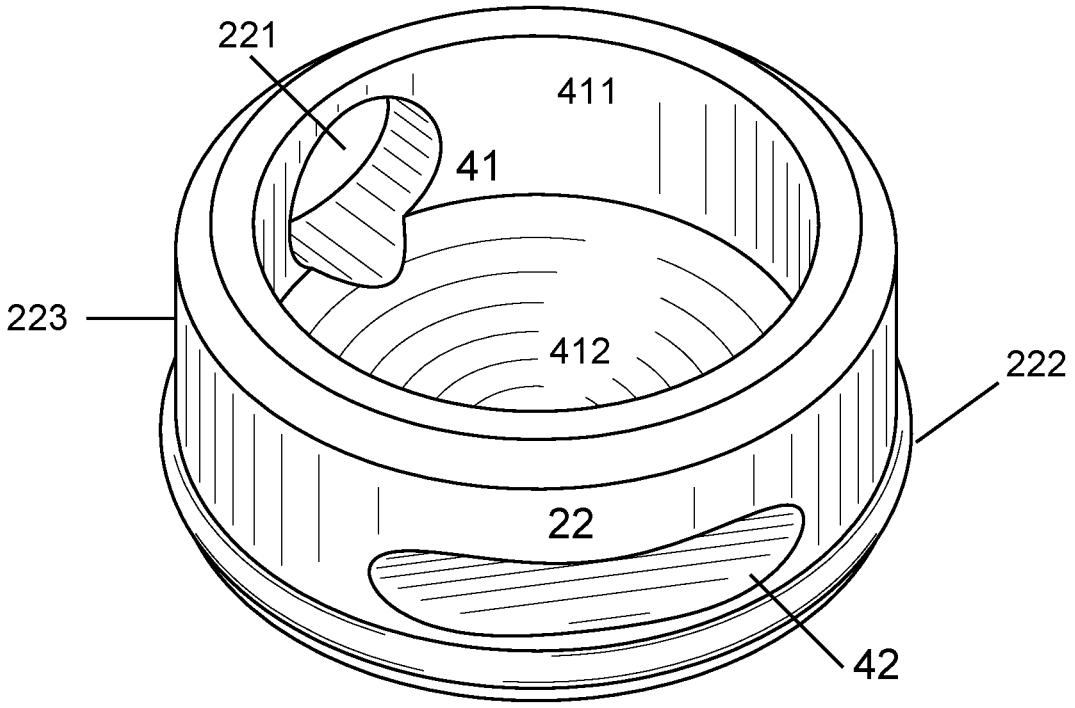
FIG. 4 is a perspective view of the "deep dish" tar trap of the present invention.
Figure 5:
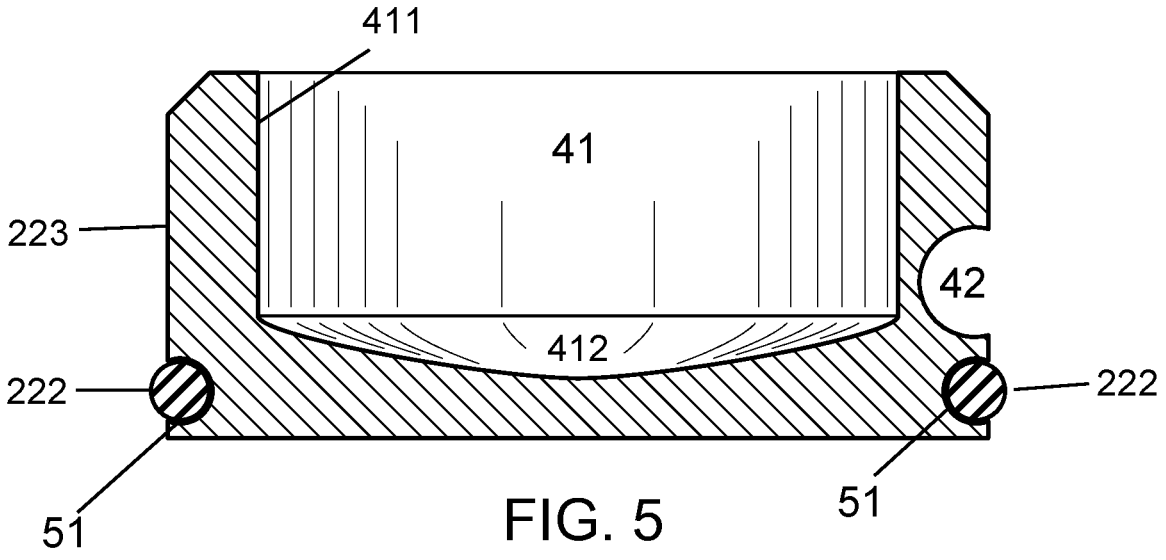
FIG. 5 is a cross-sectional view of the deep dish tar trap, cut along a diameter. This view showcases the groove-and-O-ring feature of the present invention.

The tar trap 22 is a solid brass plug that is concave on top to collect tar from burning herbs. The next major improvement in the current invention is a deepening of the tar trap. FIGS. 4 and 5 show the modified and improved tar trap with its improved deep dish 41. The deep dish 41 is created with a drill press. It has a depth of 1/4 inch. Note the vertical interior walls 411 and concavity 412. These features are improvements over Jergenson. Jergenson's tar trap only has a shallow depression on top. The deep dish serves two advantages. First, it works with the larger draft holes to increase the pipe's draw. Secondarily, it gives the tar trap greater capacity for increased use between cleanings. The deep dish helps to cool smoke before it is drawn through the smoke hole 221 into the mouthpiece 112. The dish is also deep enough to accommodate a flavor pad.

Note that the deep-dish concavity 412 sits essentially below the smoke hole 221. This keeps smoke and tar from seeping out of the tar trap into the hollow chamber 21. In Jergenson's pipe, this seepage creates a layer of residue around the tar trap, gluing the tar trap into the hollow chamber.

The improved tar trap is modified to fit better into the hollow chamber for easier insertion and removal. Jergenson's tar trap is tapered and then press fit into the hollow chamber. By contrast, the modified tar trap has a vertical external wall 223. The external wall has a circumferential groove 51. An O-ring 222 fits into the circumferential groove 51. The O-ring provides a tight seal for the tar trap when it is inserted into the hollow chamber. Because of this seal, it is not necessary to press fit the modified tar trap into the hollow chamber. The tar trap is removed for cleaning much more easily.

Figure 6A:
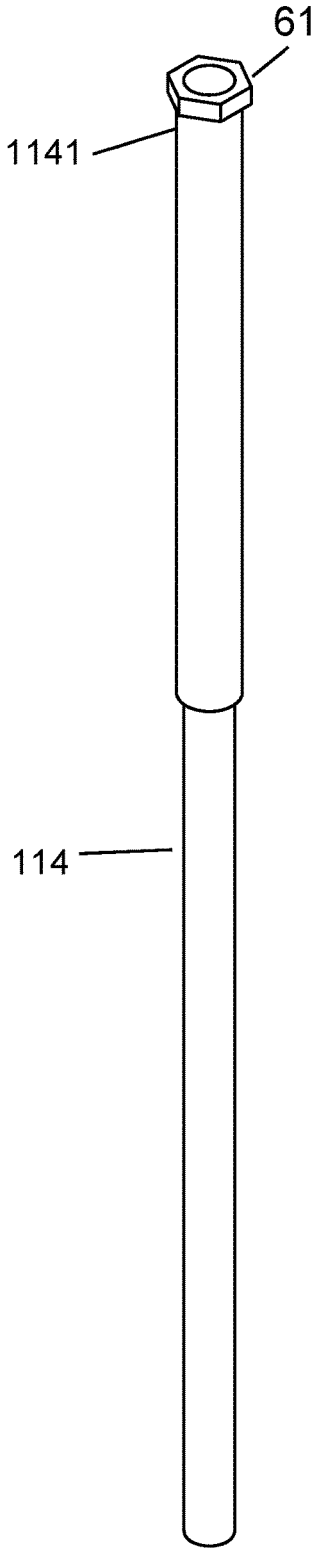
Figure 6B:
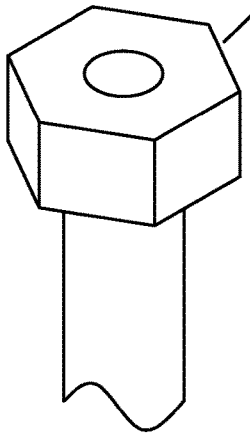
Figure 6C:
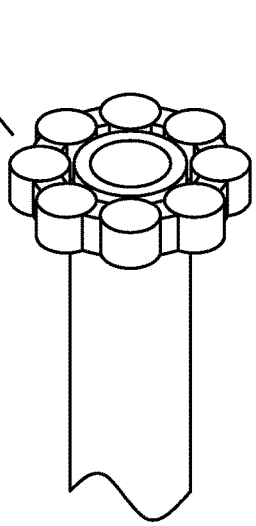
Figure 6D:
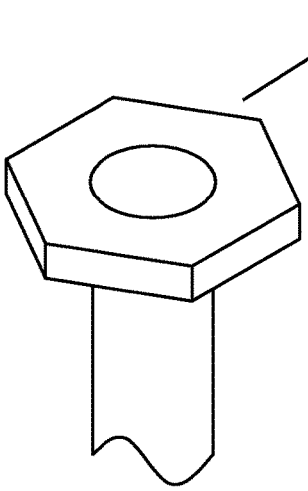
Figure 6E:
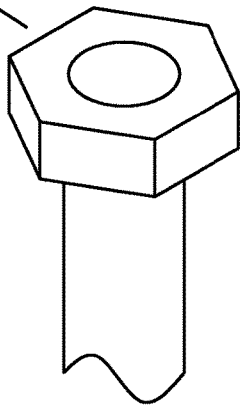

The poker 114 is a multi-functional tool. Normally, it fits in place on the underside of the pipe, as shown best in FIG. 2. The improved poker comes in two lengths: standard length and low-profile length. Since it is important to insert and remove the poker regularly, one embodiment of the present invention provides an improved grip nut 61 welded to the first end 1141 of the poker, as shown best in FIG. 6A. The grip nut provides for good grip and an easy pull to remove the poker from the poker stem 23. The grip nut comes in a variety of shapes, sizes, and designs, as illustrated in FIGS. 6B-6E. FIG. 6B shows a 1/72 solid brass grip nut. FIG. 6C is the daisy screen copper grip nut. FIG. 6D shows a 4/40 solid brass grip nut. FIG. 6E shows a 4/40 stainless steel grip nut. The grip nut also serves as an improved packing tool for the herb.

Figure 3:
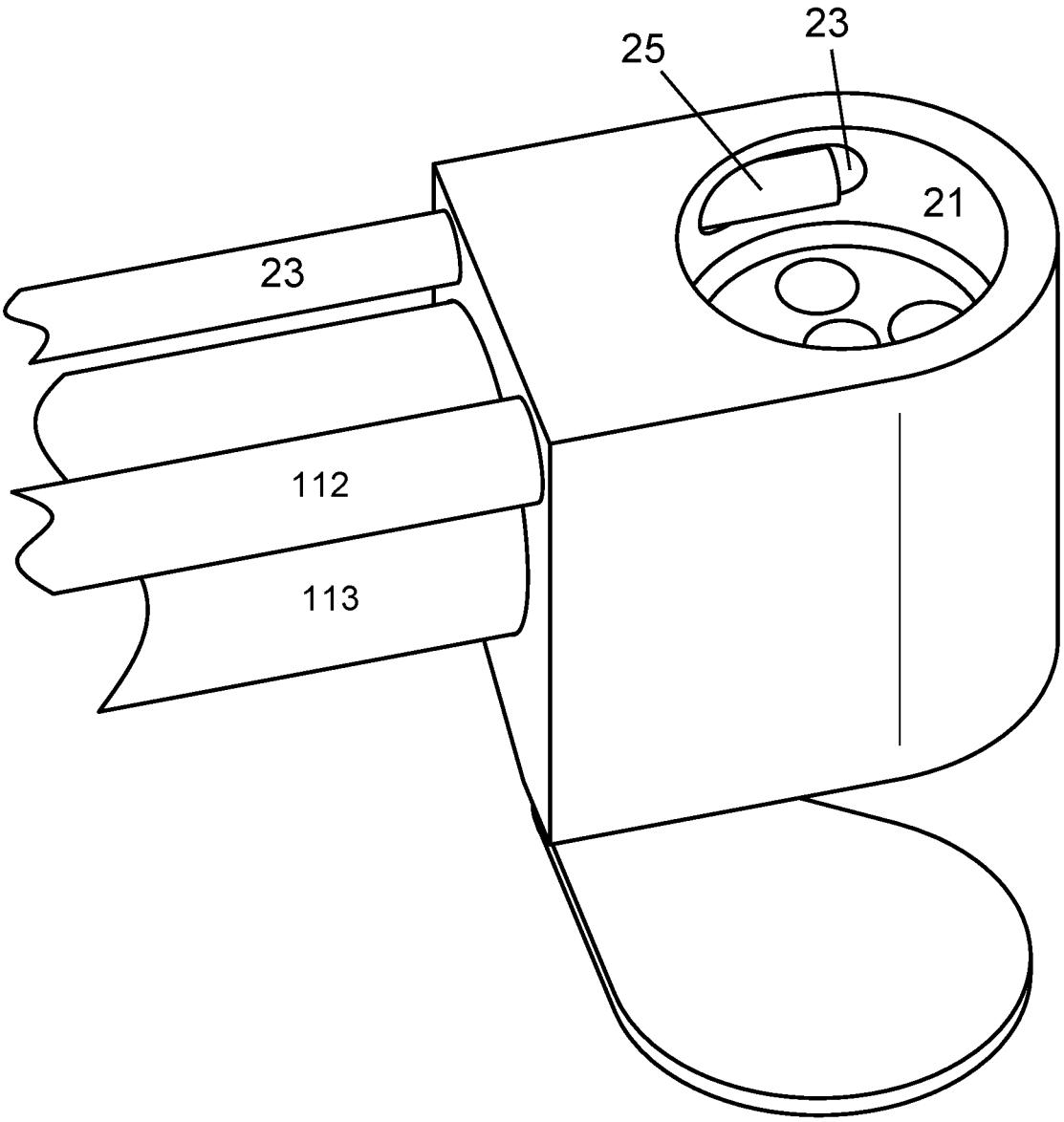
FIG. 3 is a second perspective view of the bottom of the invention, looking into the tar trap chamber.

Jergenson uses only a straight steel wire to hold the tar trap in place. The improved pipe has an enlarged poker 114. A second end 25 of the poker 114 protrudes into the hollow chamber 21, as visible in FIGS. 2 and 3. The second end of the poker fits into the poker groove 42, locking the tar trap into place. This not only secures the tar trap in the hollow chamber, but maintains the correct orientation so the smoke hole 221 correctly aligns with the entrance to the mouthpiece 112.

The poker is also used to remove the tar trap. The second end 25 of the poker 114 fits through the central draft hole 1111 of the brass bowl and pushes down on the tar trap 22. This action easily removes the tar trap. The same action is notoriously difficult for Jergenson's pipe. Jergenson's tar trap is press fit. Furthermore, without the O-ring, Jergenson's tar trap tends to get completely glued into the hollow chamber with tar.

In an alternative embodiment (not shown in the figures) the poker may take the form of a hex key or Allen wrench, with a 90° bend in the first end 1141. The 90° bend replaces the grip nut. In this embodiment, the second end 25 has a hexagonal cross-section. The hexagonal cross-section fits into the screw 115 to adjust the screw more loosely or tightly. The screw, in turn, secures the lid 116 of the pipe.

The poker may be formed of brass or a material with a high melting point such as grade 2 titanium or quartz crystal glass. Brass, titanium, and quartz crystal glass have melting points above 1,600° C. A heat-resistant poker is useful when the poker is used to dab concentrates.

Some smokers prefer to keep their herb in a quartz crystal bowl 24. The quartz crystal bowl is made of quartz crystal glass. It fits inside the brass bowl, as shown in FIG. 7. The quartz crystal bowl provided in the present invention has a central draft hole 241 and four peripheral draft holes 242. The peripheral draft holes are drilled, while the central draft hole is laser-cut. The central draft hole is oversized, with a diameter of 3/32 inch. When fitted into the brass bowl, as seen in FIG. 7, the draft holes of the quartz crystal bowl align with the draft holes of the brass bowl. Regardless of the quartz crystal bowl's orientation, its oversized central draft hole 241 will always align fully with the central draft hole 1111 of the brass bowl, allowing for maximal draw. After the pipe's first use, the burned herbs will form a resin or tar that will hold the quartz crystal bowl in place within the brass bowl.

The improved invention modifies a brass pipe to serve as a concentrate pipe. A concentrate is an herbal oil made into a concentrated wax or liquid. For example, e-juice is a tobacco concentrate used in e-cigarettes. To set up the pipe to smoke concentrate, a retaining rod 81 is fitted through the central draft hole of a quartz crystal bowl as seen in FIG. 9. The other end of the retaining rod is secured in the brass bowl 111, as shown in FIG. 10. A stabilizing hole (not shown) can be drilled in the center of the deep-dish tar trap for this purpose. The configuration shown in FIG. 10 is also known in the art as a domeless nail. A flame is then used to heat and vaporize the concentrate. Since it is subject to intense heat, the retaining rod 81 is made of material with a high melting point, ideally titanium or quartz crystal glass, which have melting points above 1,600° C.

FIG. 11 shows a quartz crystal bowl 24 fitted to a retaining rod 81. The retaining rod is long enough to accommodate up to six quartz crystal bowls, as seen stacked adjacently in FIG. 12. This configuration forms a cartridge system. The retaining rod has substantially the same length as the storage canister, making it difficult to remove the cartridge assembly from the storage canister with fingers. For this purpose, a removal tool 11-1 is provided. This is a hollow metallic stem that fits snugly over the retaining rod. A divot or slight indentation (not shown) can be added to the removal tool to make it hold the retaining rod more tightly. It is then easy to grab the removal tool and pull the cartridge assembly out of the storage canister. In the embodiment of the invention shown in FIG. 13, the removal tool 11-1 is permanently secured to the first end 1141 of the poker 114; such a poker does not have a grip nut 61.

A push nut 82 is provided to facilitate holding a quartz crystal bowl 24 on a retaining rod 81. A push nut is a washer with a concave face 821 and a convex face 822 (not shown directly). The washer is perforated with a central hole 823. The configuration of the push nut makes it unidirectional. When a push force is applied to the convex face, the central hole is slightly opened, allowing the push nut to slide along the rod in the direction of its concave face. However, when a push force is applied to the concave face, the central hole is slightly closed, making the push nut seize up on the retaining rod. In this regard, the push nut is like a Tinnerman washer.

The push nut provides support for one or more quartz crystal bowls on a retaining rod. FIGS. 9 and 10 show a quartz crystal bowl 24 sitting atop a push nut 82 on the retaining rod 81. A push nut would also be used to support the cartridge of quartz crystal bowls on the retaining rod, just out of sight in FIG. 12.

FIG. 13 shows all the parts of the assembly. When they are all put back together, the retaining rod 81 and the removal tool 11-1 fit in the storage canister. The poker 114 fits into the poker stem 23 and the tar trap 22 fits into place in the hollow chamber beneath the brass bowl 111.

I claim:

1. An improved brass smoking pipe assembly, comprising a brass smoking pipe comprising a brass bowl with a brass bowl diameter and a storage canister with a storage canister diameter;

a plurality of identical quartz crystal bowls, each with a quartz crystal bowl diameter less than the brass bowl diameter and the storage canister diameter;

each quartz crystal bowl having a top rim, a bottom surface, and a central draft hole centered in the bottom surface, said central draft hole having a central quartz crystal bowl draft hole diameter;

a retaining rod with a retaining rod diameter less than the central quartz crystal bowl draft hole diameter;

at least one support attached to the retaining rod;

a removal tool, in the form of a cylinder with at least one open end;

a hollow interior;

a diameter of the hollow interior equal to the retaining rod diameter;

and a divot in the material of the removal tool.

2. The pipe assembly of claim 1, said retaining rod composed of a material with melting point above 1,600° C.

3. The pipe assembly of claim 2, wherein the central draft hole of each quartz crystal bowl is at least 3/32 inches in diameter.

4. The pipe assembly of claim 3, wherein each support is a washer with a concave face, a convex face, and a central hole.

5. The pipe assembly of claim 4, further comprising a hollow chamber underneath the brass bowl;

a poker stem opening into the hollow chamber;

a poker with first end and second end, with the first end fitted into the poker stem;

a grip nut on the second end of the poker;

said poker stem opening into the hollow chamber;

said first end of the poker protruding through the poker stem into the hollow chamber; a tar trap in the hollow chamber, said tar trap having a vertical exterior wall;

a groove carved partly through the vertical exterior wall of the tar trap;

so that the first end of the poker fits into the groove.

6. The pipe assembly of claim 5, further comprising a layer of nickel plated onto the brass smoking pipe;

a layer of brass plated onto the layer of nickel.

* * * * *